United States Patent [19]

Thomas et al.

[11] Patent Number: 4,868,547

[45] Date of Patent: Sep. 19, 1989

[54] TRANSFORMER ALARM ANNUNCIATOR

[75] Inventors: Clifford R. Thomas, Hephzibah; John P. Johnson, Evans, both of Ga.

[73] Assignee: Georgia Power Company, Atlanta, Ga.

[21] Appl. No.: 240,492

[22] Filed: Sep. 6, 1988

[51] Int. Cl.[4] ..... G08B 21/00

[52] U.S. Cl. ..... 340/646; 340/691

[58] Field of Search ..... 340/646, 691, 657, 635; 324/55, 547; 361/35

[56] References Cited

U.S. PATENT DOCUMENTS 3,775,675 11/1973 Freeze et al. ..... 340/646 X 4,547,722 10/1985 Sarlo ..... 324/504

*Primary Examiner*—Joseph A. Orsino

*Assistant Examiner*—Jeffery A. Hofsass

*Attorney, Agent, or Firm*—Needle & Rosenberg

[57] ABSTRACT

The present invention is a transformer alarm annunciator which discloses a system that transmits a general alarm signal to a central location in response to one of a plurality of alarm conditions without blocking the signal path, so that in the event of system failure the alarm signal will still be transmitted as a transformer alarm. The device provides a means to disable a particular alarm condition while allowing the remaining alarms to be monitored.

5 Claims, 1 Drawing Sheet

TRANSFORMER ALARM ANNUNCIATOR

BACKGROUND OF THE INVENTION

This invention relates to alarm annunciators to be used for instance, with electric power transformers. More specifically, the present invention is a low-cost alarm annunciator which allows identification and disablement of alarm signals in a substation transformer.

Transformers are used throughout electric power distribution networks. Substation transformers are large transformers found at distribution substations and are important as a link in the distribution of electric power from main power transmission lines to lines which distribute power to customers in a local area. Consequently, it is understood that the monitoring of the operating characteristics of such transformers is part of assuring a reliable system.

Therefore, there are normally a number of sensors and associated alarms which identify various alarm conditions for a transformer. These alarms can be characterized as either critical or non-critical dependent on the particular set of circumstances. Generally, alarms such as the transformer oil temperature alarm, the winding temperature alarm, the low oil level alarm, the pressure relief alarm, the loss of oil pump alarm, and the tank high pressure alarm are considered critical. Non-critical alarms include the cylinder pressure alarm and the low tank pressure alarm.

Typically, all of the alarms for a particular transformer are bussed together and sent as one signal into a control house of a substation for display and into a supervisory remote computer system for transmission to a central office for many substations. Such a single transformer alarm does not identify the type of alarm condition. The use of an annunciator at the transformer identifies the particular alarm so that the onsite operator may tell which alarms are present. The annunciator allows an individual alarm signal to be isolated from the transformer alarm. In this way, the transformer may remain in service, if desired, and the occurrence of another alarm may be monitored away from the transformer.

Prior art annunciators are unduly expensive and complex. Furthermore, they rely on an independent power supply which may itself be subject to failure. Also, the voltage level in prior art annunciators is much more critical and failure due to power surges or lightning may inhibit sending alarm signals.

SUMMARY OF THE INVENTION

The present invention is a transformer alarm annunciator. More specifically, the disclosed transformer alarm annunciator discloses a system which transmits a general alarm signal to a central location in response to one of a plurality of alarm conditions without blocking the signal path, so that in the event of system failure the alarm signal will still be transmitted as a transformer alarm. The disclosed circuit design is an inexpensive design and may be powered by various DC supplies from 12 VDC to 145 VDC normally available in substations.

The transformer alarm annunciator is comprised of a plurality of individual alarm circuits, one for each alarm condition to be monitored. Each circuit can be set in an enabled or disabled mode by a switch. When enabled, the alarm circuit will monitor the specific alarm condition to determine whether an alarm signal is present at an input to the circuit. When an alarm is sensed, the alarm signal will be passed directly through to a common location by way of a transformer alarm output, which is connected to the output of all of the individual alarm circuits. In addition, an indicator such as a light emitting diode will be activated by the alarm signal. Especially in the case of non-critical alarms, it may not be immediately necessary to deactivate the transformer or fix the condition leading to the alarm. It is then desirable to isolate the pending alarm signal from the transformer alarm, to allow the transformer to remain in service while continuing to monitor for additional alarms. The particular alarm may be switched out so that another indicator is activated, but the alarm signal is no longer passed through to the common transformer alarm output.

The range of output voltage of substation DC supplies is typically between 12 volts and 145 volts. The present invention utilizes the substation DC supply to simplify the device. These DC voltages are different from substation to substation, and the present invention is designed to allow for variation in power supply without affecting its operation. The circuit design disclosed below is much less expensive than prior art commercial devices due to the use of low power simple elements such as light emitting diodes, other diodes and resistors.

Therefore, it is an object of the present invention to provide a failsafe transformer alarm annunciator.

It is a further object of the invention to provide an inexpensive annunciator which is able to operate over the wide range of voltages provided in different substation locations.

These and other objects and advantages will appear from the following description with reference to the drawings.

DESCRIPTION OF THE PREFERRED EMBODIMENT

The preferred embodiment is now described with reference to the drawings.

Figure 1:
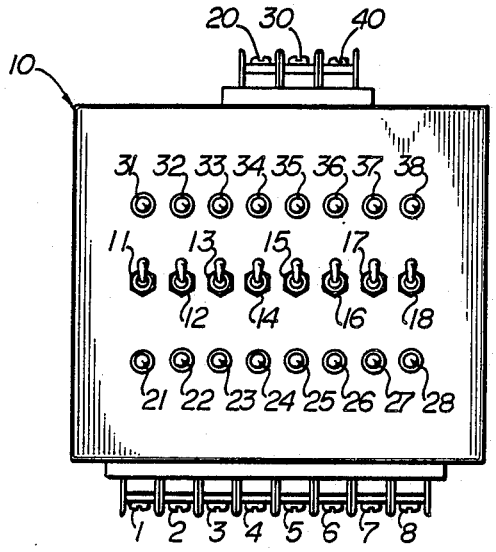
FIG. 1 is a perspective view of a transformer alarm annunciator box.

FIG. 1 shows the exterior case 10 of an embodiment of the transformer alarm annunciator, configured to handle up to eight alarm conditions. The annunciator is preferably located within an alarm box associated with a transformer. The power supply from the transformer DC supply is connected to the positive terminal 20 and the negative terminal 30. Connections to the various alarm condition signals are connected to alarm input terminals 1–8. The output transformer alarm is at terminal 40 and is connected so that it will send a signal to a central location to indicate that a alarm is present at the transformer.

A plurality of switches, in this case eight switches 11–18, are associated with individual alarm conditions. In normal operation the switches are in an enabled position which allows an alarm circuit associated with each alarm condition to sense the alarm and pass the alarm signal to the transformer alarm terminal 40. When a switch is in the enable position and the alarm condition is not present, no light indication is present. However, when an alarm does occur, an indicator 21–28 does light up and the alarm signal is sent out as a transformer alarm.

An operator who is notified by the transformer alarm that an alarm condition exists can then go the transformer alarm annunciator and identify which alarm condition exists by noting which indicator 21–28 is lit. If the operator determines that the transformer may remain in operation despite the alarm, the switch for that alarm may then be changed to the disable position, which blocks that signal from the transformer alarm terminal and lights the appropriate disable indicator 31–38. In this way, if a second alarm condition occurs, it will then send a new transformer alarm signal to the central location.

Figure 2:
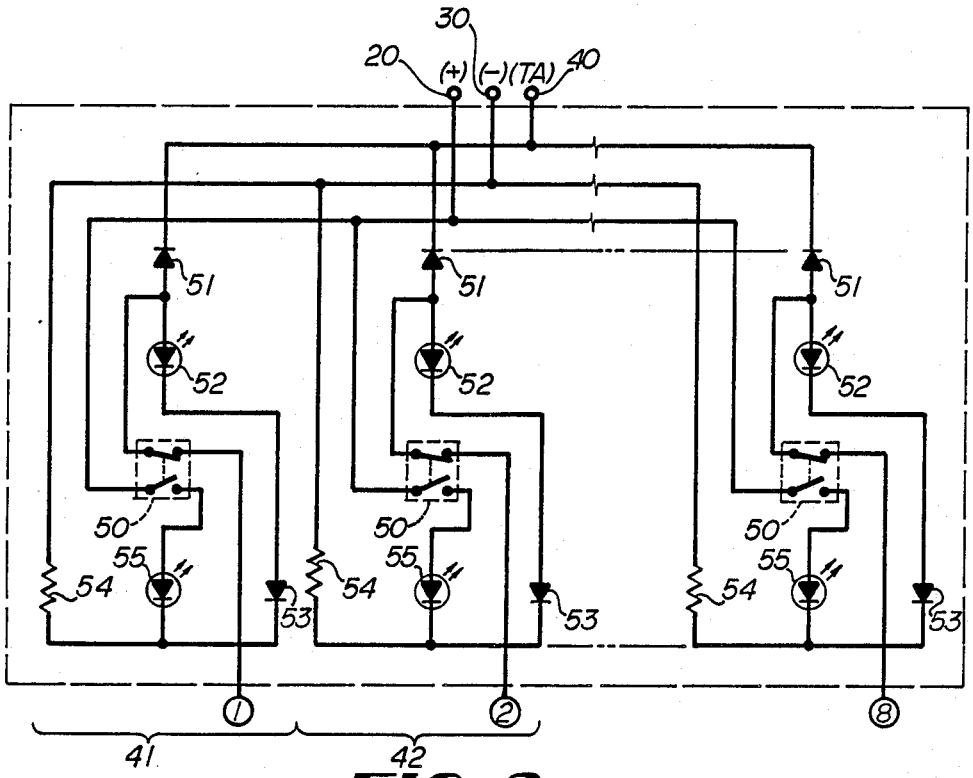
FIG. 2 is a circuit diagram for the transformer alarm annunciator.

FIG. 2 is a circuit diagram of two circuits 41, 42 of a plurality of alarm circuits of the transformer alarm annunciator. In the embodiment shown in FIG. 1 there will be eight such circuits. Each alarm circuit is connected to the common power supply terminals 20, 30 and the transformer alarm output 40.

Each circuit is controlled by a double pole-double throw switch 50 which, depending on its position, either closes an enable circuit and opens a disable circuit, or vice versa. The enable circuit comprises a connection to the associated alarm condition signal 1–8, through the switch 50, then both sending the signal through diode 51 to the transformer alarm output 40 as well as to light emitting diode 52 through diode 53 and resistor 54 to the common negative terminal 30. The disable circuit, which is activated at the same time the enable circuit is switched to an open circuit condition, provides power from the positive contact 20 through light emitting diode 55 and resistor 54 to the common negative 30. The resistor 54 is chosen to limit the current through the light emitting diodes 52, 55, allowing for variance in the voltage of the signals and the power supply.

The diodes 51, 53 may be type SK3051; the light emitting diodes 52, 55 may be type 4304H5, and resistor 54 is preferably 6.8 kohm plus or minus 10%. Light emitting diodes 52 and 55 are preferably of different colors or have different color lenses to further aid in distinguishing the alarm condition.

While the invention has been described in detail with particular reference to the preferred embodiment thereof, it will be understood that variations and modifications can be effected within the spirit and scope of the invention as previously described and as defined by the claims.

What is claimed is:

1. A transformer alarm annunciator, to be powered by connection to the transformer DC supply, which comprises:

a plurality of alarm circuits, each alarm circuit having an alarm input for connection to separate transformer alarm signals, and each alarm circuit having an alarm output connected to a common transformer alarm indicating output, for sending a transformer alarm signal to a remote location;

wherein each alarm circuit comprises two electrical paths through a common double-pole double-throw switch such that either a first of said two electrical paths is closed and a second of said two electrical paths is open, or said first electrical path is open and said second electrical path is closed, depending on the position of said switch;

said first electrical path comprising two parallel paths connected to said alarm input, the first of said parallel paths connected to the alarm output through a diode and the second of said parallel paths comprising a first indicator light, for indicating the particular alarm condition, a diode and a resistor in series connected to a common negative terminal; and said second electrical path comprising a second indicator light, for indicating that the particular alarm condition has been disabled, in series with a resistor, connected between the transformer DC supply and the common negative terminal;

such that each alarm circuit may be placed in a ready state by enabling said first electrical path so that when the particular alarm condition occurs said first indicator light will be lit for that alarm circuit while sending a transformer alarm signal to a remote location, and so that the particular alarm indication may be disabled by switching the alarm circuit to enable said second electrical path, thereby terminating the particular alarm signal and having said second indicator light indicate that the alarm circuit is disabled.

2. The transformer alarm annunciator of claim 1, wherein all of said light indicators are light emitting diodes.

3. The transformer alarm annunciator of claim 2, wherein the power supplied from the transformer DC supply may be in the range of 12 to 145 volts.

4. The transformer alarm annunciator of claim 3, wherein each resistor is in the range of six thousand eight hundred ohms, plus or minus 10%.

5. The transformer alarm annunciator of claim 1, wherein a single resistor connected to said common negative terminal is used in both said first and second electrical paths.

* * * * *